US005423158A

United States Patent [19]

Vora

[11] Patent Number: 5,423,158

[45] Date of Patent: Jun. 13, 1995

[54] VERTICALLY ERECTED MAST

[75] Inventor: Theodore C. Vora, Bellaire, Tex.

[73] Assignee: Continental Emsco Company, Garland, Tex.

[21] Appl. No.: 41,778

[22] Filed: Apr. 2, 1993

[51] Int. Cl.[6] ..... F04G 21/00; F04H 12/34

[52] U.S. Cl. ..... 52/745.17; 52/121; 52/123.1; 52/632

[58] Field of Search ..... 52/118, 121, 122.1, 52/123.1, 632, 651.05, 651.07, 745.04, 745.17, 745.18

[56] References Cited

U.S. PATENT DOCUMENTS

| | | | |
|---|---|---|---|
| 2,763,339 | 9/1956 | North | 52/121 |
| 2,804,949 | 9/1957 | Woolslayer et al. | 52/121 |
| 3,403,485 | 6/1965 | Cernosek | 52/121 |
| 3,828,513 | 8/1974 | Vanderklaauw | 52/745.04 |
| 3,945,107 | 3/1976 | Houck | 54/121 X |
| 4,134,237 | 1/1979 | Armstrong | 52/118 |
| 4,231,148 | 11/1980 | Harding | 52/745.17 |
| 4,393,630 | 7/1983 | Knox | 52/121 |
| 4,590,720 | 5/1986 | Reed | 52/121 |
| 4,837,992 | 6/1989 | Hashimoto | 52/118 |
| 4,885,893 | 12/1989 | Wasterwal et al. | 52/123.1 |
| 5,247,776 | 9/1993 | Tamayo | 52/745.17 |

FOREIGN PATENT DOCUMENTS

| | | | |
|---|---|---|---|
| 0312286 | 10/1988 | European Pat. Off. . | |
| 2524531 | 10/1983 | France . | |
| 1596046 | 9/1990 | U.S.S.R. | 52/745.18 |

OTHER PUBLICATIONS

Dreco Energy Services, Ltd., 1992–93 Catalog p. 936.

*Primary Examiner*—Carl D. Friedman
*Assistant Examiner*—Winnie Yip
*Attorney, Agent, or Firm*—Arnold, White & Durkee

[57] ABSTRACT

A method and apparatus for erecting a vertical mast 10 on a drill platform 15 with minimal reliance on existing cranes. An elevator guide section 20 is first constructed on the platform 15. The elevator guide section 20 has one open side for receiving the mast top section 40, mast bottom section 70, and one or more mast intermediate sections 58A–D, all of which, have approximately the same horizontal cross section. A pair of mast elevators 28A–B are slidably coupled to the elevator guide section 20. By means of the existing platform crane, the top section 40, which has a prestrung crown block 45 and travelling block 46, is placed within the elevator guide section 20 and on the elevators 28A–B. Lifting power is transmitted to the elevators 28A–B by the existing drawworks 52 via the travelling block 46. Through a series of vertical movements of the elevators 28A–B, the top section 40 is raised and one more intermediate sections 58A–D are stacked thereunder. After the last of the intermediate sections 58A–D is positioned under the top section 40, the bottom section 70 is lifted within the elevator guide section 20, and the top and intermediate sections 40, 58A–D are lowered thereon to form a complete mast 10 with sections of approximately the same horizontal cross section.

2 Claims, 6 Drawing Sheets

Fig. 4
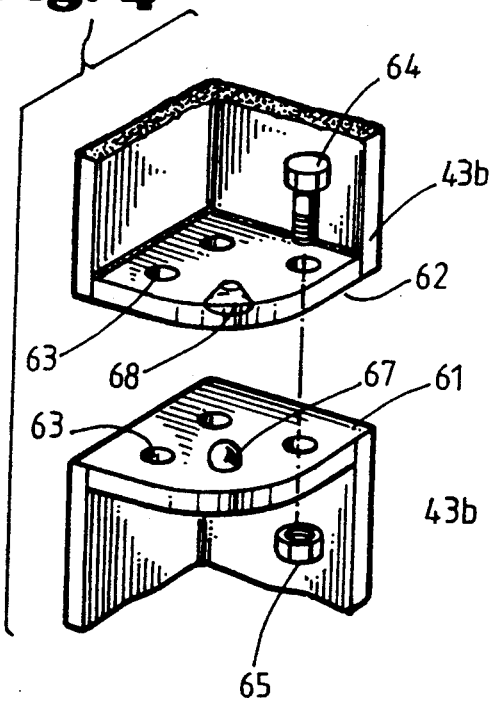
Fig. 12
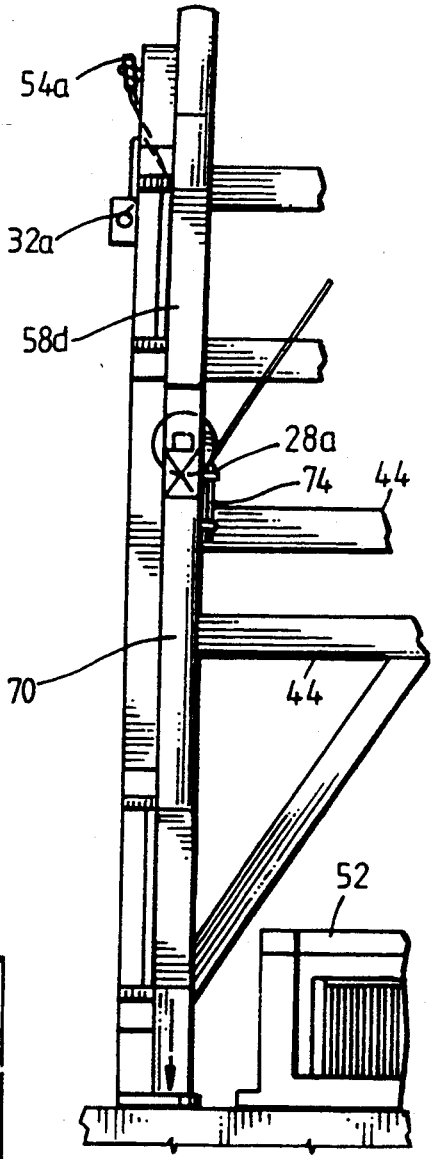
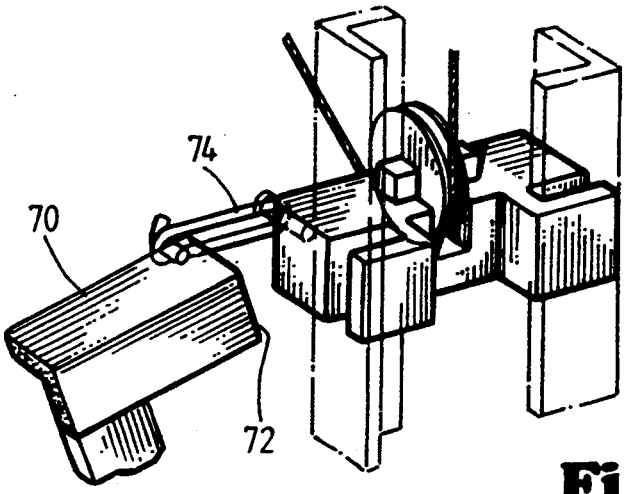
Fig. 11

Fig. 6
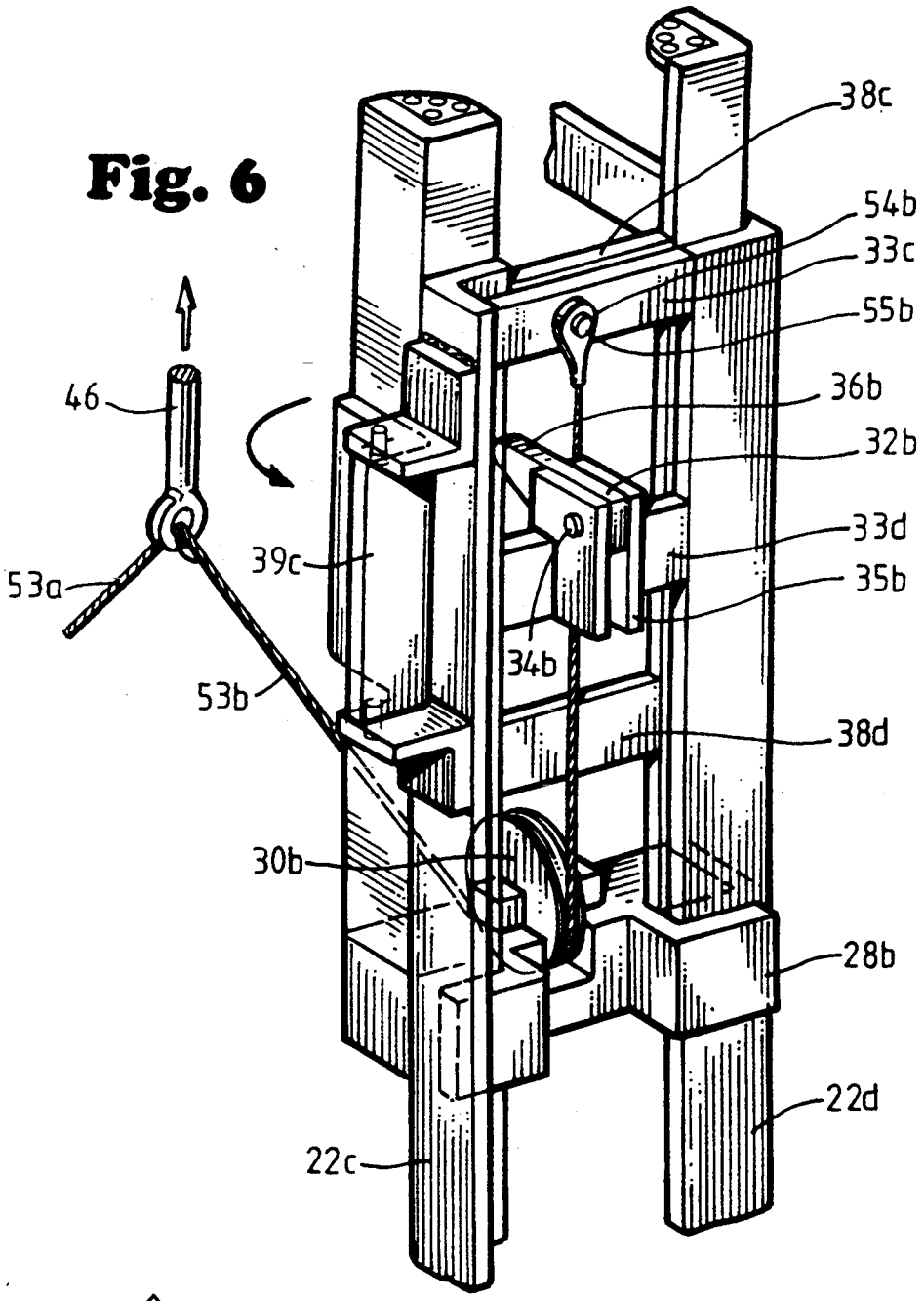
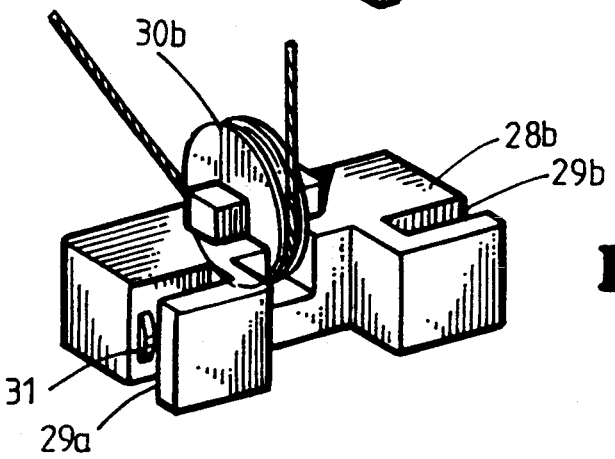
Fig. 7

Fig. 8
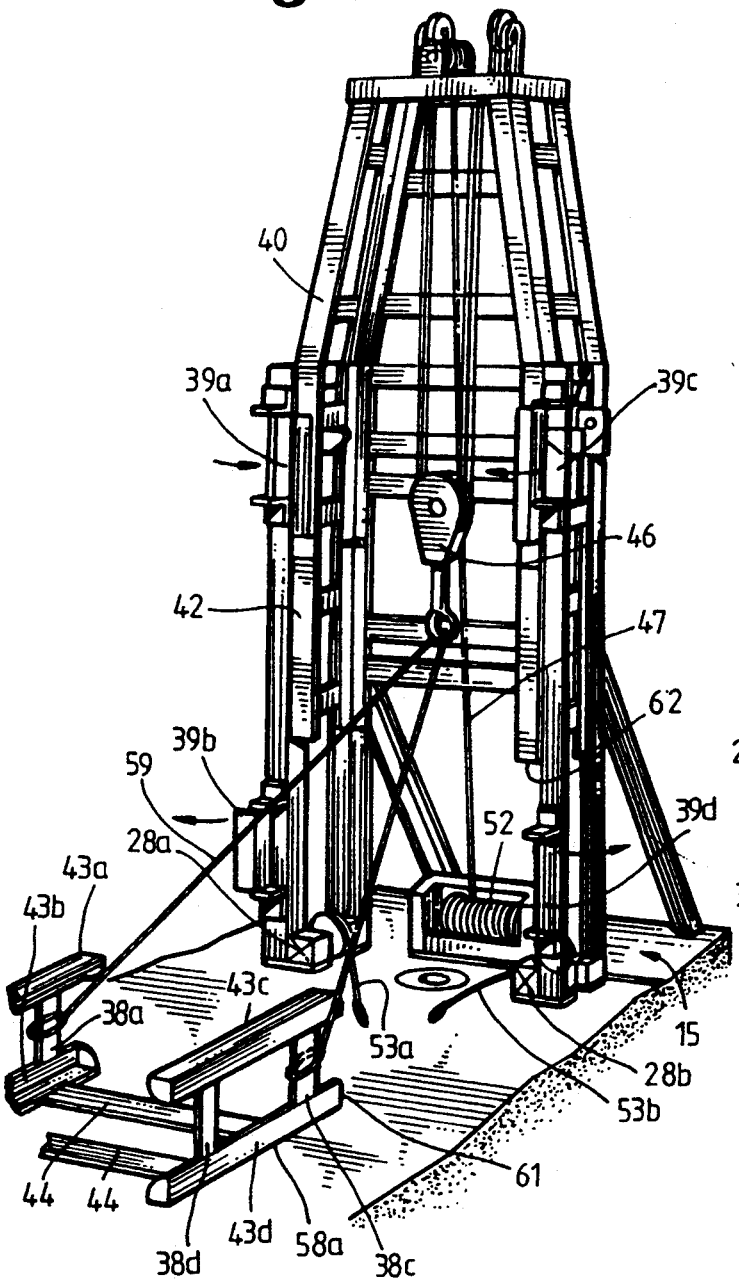
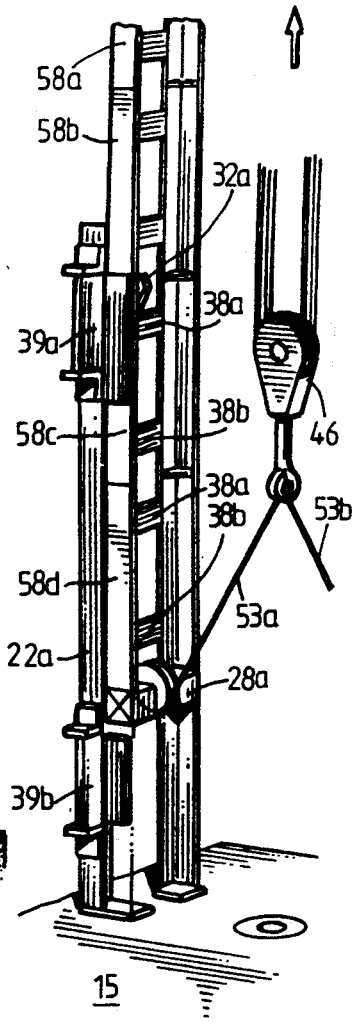
Fig. 9

VERTICALLY ERECTED MAST

BACKGROUND OF THE INVENTION

1. FIELD OF THE INVENTION

The invention relates generally to highly mobile, vertically erected masts for drilling rigs. More particularly, the invention relates to a method and apparatus for erecting a multi-sectioned vertically disposed mast on a drill platform using the existing platform drawworks.

2. DESCRIPTION OF THE RELATED ART

Different types of masts have been devised for use in the drilling industry. In offshore or remote area drilling operations, it is desirable for such masts to be portable from one well to the next. Portability is also preferred for offshore operations that may be subjected to severe weather. In such cases, it is desirable to be able to quickly dismantle the mast to avoid potential damage, and even destruction.

Drillers have typically used two types of portable or semi-portable masts in offshore or remote drilling environments. The first type consists of a folded mast which typically has a lower end pivotally connected to either the drill platform or, in the case of a truck mounted mast, the rear of the truck. In raising, either by the available platform crane, drawworks, or a separate winch, the folding mast pivots from a horizontal position to a vertical position, where it is typically secured.

The second type of portable or semi-portable mast known in the art consists of a two- or three-section telescoping mast wherein the upper section is telescoped into the lower section and the entire assembly is transported from one location to the next. Such masts are typically transported horizontally to the drill platform and jackknifed into a vertical position. From this vertical position, the sections are then extended telescopically.

Both the folding and telescoping masts, while providing some mobility and stability during transportation, have certain disadvantages. In offshore or remote area drilling, there may only be small capacity cranes available for mast erection. Mast structures that telescope into a single assembly can exceed the weight and size limitations of the crane. In the case of truck-mounted folding masts, the overall length of the mast may be limited by the length of the truck.

U.S. Pat. No. 4,134,237, issued to Armstrong, describes a multi-sectioned telescoping mast, wherein the upper-most mast section is inserted into the lower-most mast section which is fixed vertically to the drilling platform. The uppermost mast section is raised within the lower mast section by a cable, which is connected to a spool driven by the platform drawworks. The intermediate mast section is inserted and secured to the lower end of the uppermost mast section. While the uppermost and intermediate masts sections are held in position, the cable is lowered to engage the lower end of the intermediate mast section and the drawworks is actuated to raise the uppermost and intermediate mast sections to enable the lower end of the intermediate mast section to be coupled to the upper end of the lowermost mast section.

The Armstrong device, while apparently solving some of the problems of the prior art devices, also has some inherent disadvantages. The Armstrong device requires a special cable to be placed on the drawworks spool. The drawworks spool has a grooved surface which may be damaged if the dimensions of the special cable do not match the dimensions of the spool grooves. Moreover, the Armstrong device requires the crown block and travelling block to be strung with cable after the mast is erected. This is a cumbersome procedure since the crown block may be over a hundred feet above the drilling floor. In addition, the upper sections of the Armstrong mast are coupled to each other and to the lowermost section with an offset. Therefore, the load on the mast must be carried by an offset connection that couples together the upper sections and the lowermost section.

The present invention is directed to overcoming or minimizing one or more of the problems discussed above.

SUMMARY OF THE INVENTION

A multi-sectioned mast for erection on a drilling platform having a drawworks, includes a guide section coupled to the platform, the guide section having a generally U-shaped cross-sectional configuration with its open side extending along substantially the entire length of the guide section. A bottom section is coupled to the platform and has a cross section dimensioned to substantially conform to the interior dimensions of the guide section. A top section is positioned above the bottom section, the top section having a cross section substantially similar to the cross section of the bottom section, the top section having a crown block and a travelling block, the crown block and the travelling block being strung with cable prior to erection. A plurality of intermediate sections is stacked consecutively with the lower end of the lowermost of the intermediate sections being coupled to the upper end of the bottom section and the upper end of the uppermost of the intermediate sections being coupled to the lower end of the top section, each of the intermediate sections having a cross section substantially similar to the cross section of the top and bottom sections. An elevating mechanism is slidably coupled to the guide section and removably coupled to the travelling block, the elevating mechanism being operable to translate each of the top, intermediate, and bottom mast sections vertically in response to movement of the cable. A pair of lock latches is pivotally coupled to the sides of the guide section, one end of each of the lock latches protruding into the interior of the U-shaped guide section, the lock latches adapted to permit upward translation of the top and intermediate sections, and adapted to engage the sides of the top and intermediate sections to prevent downward translation of the sections.

In another embodiment of the present invention, a method is provided for assembling a mast having a plurality of sections on a drilling platform which has a drawworks and a crane. The method comprises the steps of erecting a guide section on the drill platform, placing a mast top section within the guide section, raising the mast top section to a first elevated position, coupling at least one mast intermediate section to the bottom of the mast top section, raising the mast top section to a second elevated position, and coupling a mast bottom section to the bottom of the lowermost mast intermediate section such that the bottom of the mast bottom section rests on the platform.

In another embodiment of the present invention, a method is provided for assembling a mast having a plurality of sections on a drilling platform which has a drawworks and a crane. The method includes erecting a guide section on the drill platform, the guide section being vertically disposed with respect to the drill platform, the guide section having a pair of mast elevators operable to translate the mast sections vertically with respect to the guide section, the guide section having a plurality of lock latches to temporarily hold the sections when the elevators are translating downward with respect to the elevator guide section. By means of the crane, a mast top section is placed on the elevators, the mast top section being vertically disposed within the guide section, the mast top section having a crown block pre-strung with a first cable and coupled to the mast top section, the crown block having a travelling block suspended therefrom by, and prestrung with, said first cable, said travelling block being operatively coupled to said drawworks by said first cable, and operatively coupled to said elevators by a second cable and a third cable. By means of the drawworks and the travelling block, the elevators are raised such that the bottom of the top section is held in position by the lock latches. By means of the drawworks and travelling block, the elevators are lowered to the drill platform. By means of the drawworks and travelling block, a mast intermediate section is placed on the mast elevators, the mast intermediate section being vertically disposed within the guide section. By means of the drawworks and travelling block, the elevators are raised until the mast intermediate section contacts the mast top section such that the sections may be coupled. By means of the drawworks and travelling block, the elevators are raised such that the bottom of the mast intermediate section is held in position by the lock latches. The steps of lowering the elevators to the platform, placing a mast intermediate section on the elevators, and raising the elevators are repeated, wherein the top of each subsequent mast intermediate section is coupled to the bottom of the previous mast intermediate section, until all mast intermediate sections have been positioned. A mast bottom section is coupled to the elevators. By means of the drawworks and travelling block, the mast bottom section within the guide section in a vertical disposition. The mast bottom is then disconnected from the elevators. By means of the drawworks and the travelling block the elevators are raised to disengage the last installed mast intermediate section from the lock latches. By means of the drawworks and travelling block, the elevator is lowered such that the mast bottom section engages the lower sides of the elevators and the last installed mast intermediate section engages the upper side of the elevator. The mast intermediate and bottom sections are then coupled to the elevators.

BRIEF DESCRIPTION OF THE DRAWINGS

Other objects and advantages of the invention will become apparent upon reading the following detailed description and references to the drawings in which:

FIG. 4 depicts an exemplary coupling between legs of two mast sections, illustrated in an exploded view;

FIG. 6 depicts a detail of an exemplary mast elevator and lock latch, illustrated in a partial side pictorial view;

FIG. 7 depicts a detail of an exemplary mast elevator, illustrated in a partial side pictorial view;

FIG. 8 depicts an elevator guide section with a mast top section positioned therein and a mast intermediate section in a pre-installation position, illustrated in a partial front pictorial view;

FIG. 9 depicts an exemplary mast elevator and lock latch in operation, illustrated in a partial front pictorial view;

FIG. 11 depicts an exemplary coupling between one elevator and the mast bottom section, illustrated in a partial side pictorial view; and FIG. 12 depicts an exemplary coupling between one elevator, one mast intermediate section, and the mast bottom section, illustrated in a partial front pictorial view.

Figure 1:
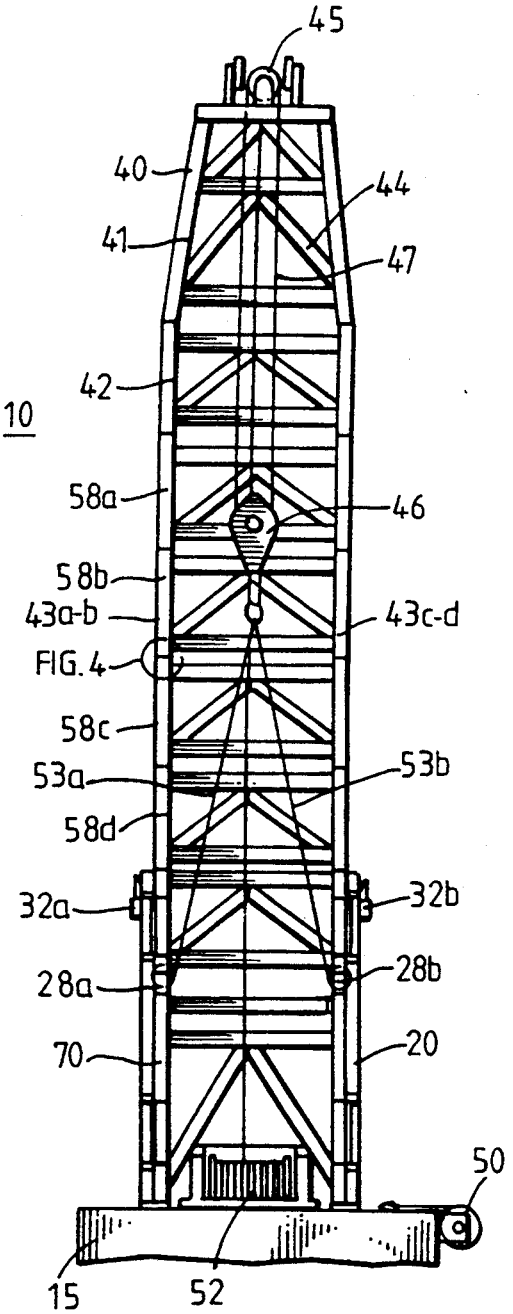
FIG. 1 depicts an exemplary fully erected mast, illustrated in a front schematic view.

While the invention is susceptible to various modifications and alternative forms, a specific embodiment thereof has been shown by way of example in the drawings and will therein be described in detail. It should be understood, however, that this specification is not intended to limit the particular form disclosed herein, but on the contrary, the intention is to cover all modifications, equivalents, and alternatives falling within the spirit and scope of the invention, as defined by the appended claims.

DESCRIPTION OF THE PREFERRED EMBODIMENTS

FIG. 1 shows a front view of a vertically erected mast 10 in a fully erect position on a drill platform 15. The drill platform 15 may be any land based or offshore drill platform. The mast 10 includes an elevator guide section 20, a top section 40, a plurality of intermediate sections 58A–D, and a bottom section 70.

The erection of the mast 10 is conducted in a series of operations. The first operation involves the erection of the elevator guide section 20 on the platform 15. The various components of the mast 10 are unloaded from the transport vehicle, typically a ship or a truck as the case may be, and placed on the platform 15 by a crane (not shown) commonly located on the platform 15.

Figure 5:
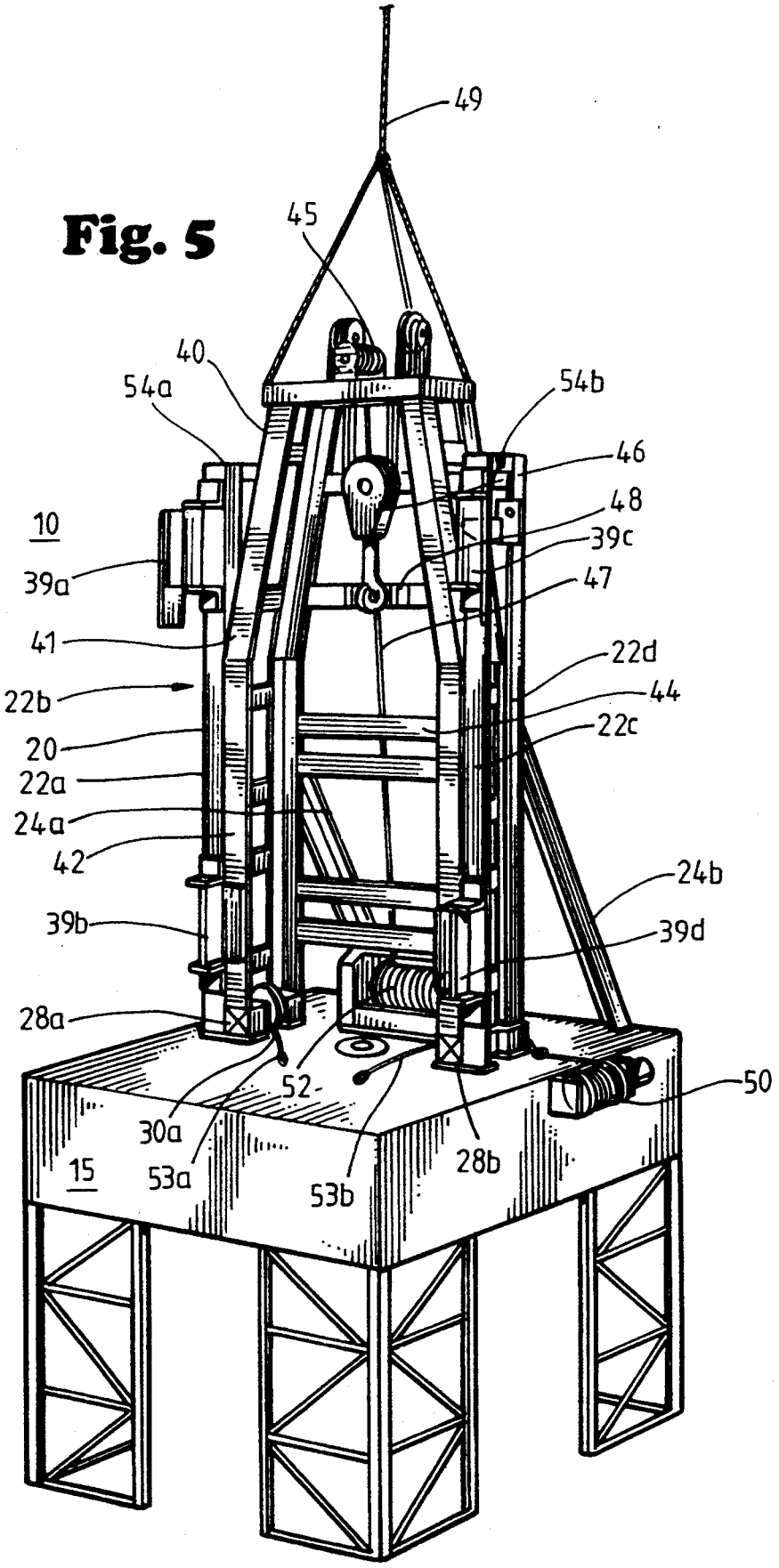
FIG. 5 depicts an elevator guide section installed on a platform and having a mast top section positioned therein, illustrated in a front pictorial view.

Referring now also to FIG. 5, which shows a front view of the elevator guide section 20 with the top section 40 positioned therein as will be described more fully, the elevator guide section 20 preferably comprises four vertically mounted legs 22A–D that are couple, to the platform 15 in pairs 22A–B and 22C–D so as to form a generally rectangular cross section when viewed from above. The relative orientation of the individual legs 22A–D can be seen more clearly in FIG. 6, which shows legs 22C–D. The legs 22C–D are preferably 90 degree angle irons, though other cross sections are possible, such as I-beams.

The size of the particular elevator guide section 20 will depend on the horizontal cross-sectional area of the mast 10, however, it is preferred that the spacing between the two adjacent legs, such as 22C–D, should be sufficient to allow workmen and equipment to pass between the legs 22C–D on the platform 15. As can be seen more clearly in FIG. 5, angular braces 24A–B are coupled to the elevator guide section 20 and platform 15 to provide stability. The connections between the legs 22C–D and the platform 15, as well the connections between the various components of the elevator guide section 20 or the other mast sections to be discussed below may be made using known metal coupling methods such as bolting, pinning, riveting, or similar methods.

Figure 2:
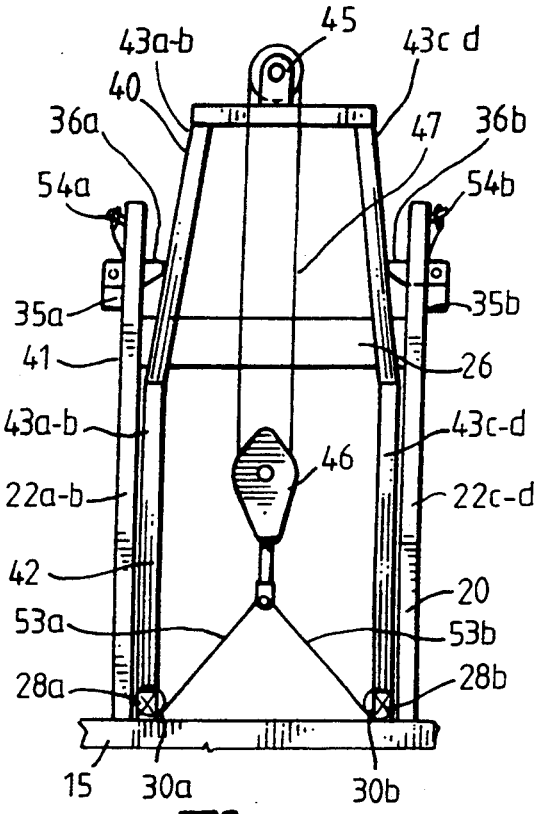
FIG. 2 depicts an elevator guide section with a mast top section placed therein, illustrated in a front schematic view.

As shown in FIG. 2, which shows a schematic front view of the elevator guide section 20 with the top section 40 positioned therein, as will be described more fully below, the elevator guide section 20 also includes a horizontal brace 26, which couples each pair of legs 22A–B and 22C–D together to increase stability. However, horizontal brace 26 may be omitted to enable movement of equipment between the pairs of legs 22A–B and 22C–D.

Referring again to FIGS. 6 and 7, a mast elevator 28A–B is slidably mounted on each pair of legs 22A–B and 22C–D. The mast elevators 28A–B are designed to raise and lower the various components of the mast 10. Each mast elevator 28A–B has a pair of slots 29A–B that are configured such that each slot 29A–B slidably engages complimentary sides of the legs 22C–D as shown in FIGS. 6 and 7. An elevator sheave 30A–B is rotatably mounted on each elevator 28A–B to enable lifting power to be transmitted to the elevators 28A–B as discussed more fully below.

To facilitate smooth sliding of the elevators 28A–B and thus reduce friction and wear, it is preferred that slots 29A–B include a plurality of rollers 31, or similar devices, which should be lubricated with a suitable grease or other lubricant.

Referring to FIGS. 2, 5–6, and 9, a pair of horizontal braces 33A–B is connected to legs 22A–B and another pair of horizontal braces 33C–D is connected to legs 22C–D. A lock latch 32A–B is pivotally connected to horizontal braces 33B and 33D on each pair of legs 22A–B and 22C–D by way of pins 34A–B and brackets 35A–B. Each lock latch 32A–B has a tapered portion 36A–B. Each mast section has one or more horizontal braces 38A–D that are parallel to the horizontal braces 33A–D on the pairs of legs 22A–B and 22C–D. The lock latches 32A–B have a first stationary position which is shown in FIG. 6. FIG. 9 shows a partial view of the intermediate sections 58A–D and thus only braces 38A–B, however, it is illustrative of the full structure. As a particular mast section translates upward vertically, the section braces 38A–B pivot the lock latches 32A–B upwards. When the particular mast section reaches a particular height, the braces 38A–B lose contact with lock latches 32A–B and the lock latches 32A–B pivot down to their stationary positions. The tapered portion 36A–B of the lock latches 32A–B is designed to enable the mast sections to slide easily past the lock latches 32A–B while the horizontal braces 38A–B slidably engage and pivotally rotate the lock latches 32A–B as the sections are translated upward vertically.

As shown in FIG. 5, pivoting brackets 39A–D are pivotally mounted on legs 22A, 22C. Pivoting brackets 39A–D are intended to prevent the mast 10 or individual mast sections 40, 58A–D, and 70 (not shown in FIG. 5) from tipping over during and after erection. Pivoting brackets 39A–D are themselves preferably angled irons that are adapted to swing inward to a closed position as shown in FIG. 6, and outward to an open position as shown in FIG. 5 with reference to bracket 39A. However, it will be apparent to those skilled in the art that other structures may be suitable to perform the functions of the pivoting brackets 39A–D.

The mechanism for actuating and holding pivoting brackets 39A–D in position is not shown. However, a variety of methods known to those skilled in the art may be used, such as manually rotating the brackets 39A–D and fixing their positions by pins. In addition, a simple spring mechanism which biases the brackets 39A–D inward in combination with anchoring pins, or a hydraulic or pneumatic piston arrangement may be suitable.

The next operation involves the placement of the top section 40 of the mast 10. Referring to FIGS. 1 and 2, the top section 40 preferably comprises an upper tapered section 41 coupled to one or more vertical sections 42, all of which are composed of a plurality of legs 43A–D that are interconnected by a plurality of horizontal and diagonal braces 44. The exact structure of the top section, including the number and types of bracing, is a matter of discretion on the part of the designer. For example, the top section 40 need not have a tapered section 41, but may be of uniform cross section. For the sake of clarity, the braces 44 may or may not be shown in FIGS. 2–12.

The crown block 45 sits atop the tapered portion 41. A travelling block 46 is suspended from the crown block 45 by drawworks cable 47. Referring to FIG. 5, a rack 48 is coupled to the top section 40. The rack 48 is adapted to hold and prevent the travelling block 46 from swinging about during transport and construction.

The top and intermediate sections 40, 58A–D have the same general horizontal cross section as the elevator guide section and are sized to be small enough in horizontal cross-sectional area to translate freely in the vertical direction within the elevator guide section 20.

Referring to FIG. 5, by means of cable 49 leading to the existing platform crane [not shown], the top section 40 is hoisted from its typically horizontal position on the platform 15 into a vertical position, within elevator guide section 20 and seated on the elevators 28A–B. The top section 40 is preferably transported with the crown block 45, the travelling block 46, and the spool 50, all preloaded with the same type of drawworks cable 47 that will be used on the platform drawworks 52. After the top section 40 has been positioned within elevator guide section 20, pivoting brackets 39A–D are rotated inward to stabilize top section 40. The drawworks 52 is then loaded with cable 47 from spool 50 and the spool 50 stowed as shown.

At this point in the construction, the combination of the drawworks 52, crown block 45, and travelling block 46 is fully functional. Thus, at this early stage of construction, the partially constructed mast 10 can provide a significant lifting capability.

The elevators 28A–B translate up and down in response to up and down translation of travelling block 46. As shown in FIGS. 2 and 6, the travelling block 46 is coupled to each elevator 28A–B by way of cables 53A–B which stretch from the travelling block 46, around sheaves 30A–B, and terminate at shackle connections 54A–B. The shackle connections 54A–B are secured to braces 33A, 33C by pins 55A. Those skilled in the art will appreciate that the pins 55A–B may have to withstand significant shear and bending stresses, therefore, the size and particular configuration for the pins should be chosen accordingly.

Figure 3:
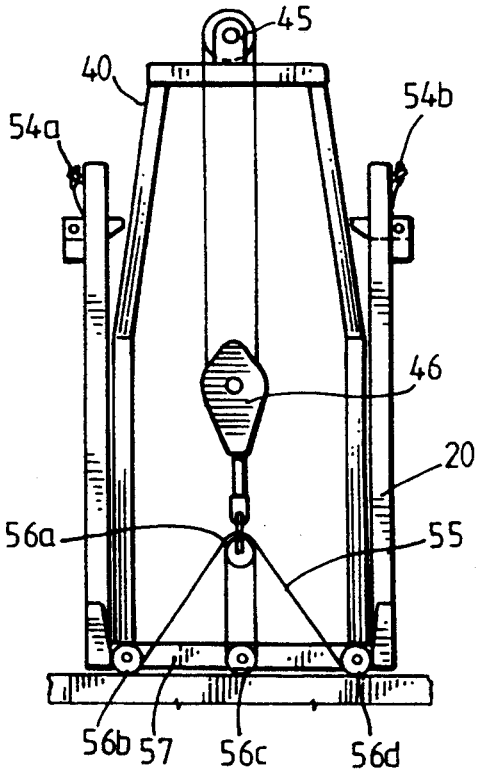
FIG. 3 depicts an alternate embodiment of an elevator guide section with a mast top section placed therein, illustrated in a front schematic view.

In an alternate embodiment shown in FIG. 3, the travelling block 46 transmits lifting force to the various mast sections by way of a cable 55 that is looped about a plurality of sheaves 56A–D. Sheave 56A is coupled to the travelling block 46 and sheaves 56B–D are coupled to an elevating platform 57. The elevating platform 57 functions similarly to the elevators 28A–B, though in this alternate embodiment, the vertical movement of the travelling block 46 necessary to raise and lower the elevator platform 57 will be less than the vertical movement of the travelling block 46 required to raise and lower the elevators 28A–B.

Referring to FIG. 6, after cables 53A–B are coupled to the travelling block 46, the drawworks 52 is activated to raise the travelling block 46, the elevators 28A–B, and thus the top section 40. The top section 40 is elevated until the bottom-most braces 38B, 38D pass lock latches 32A–B such that the lock latches 38A–B pivot first upward and then back down to their original position. The top section 40 is then lowered until braces 38B, 38D rest on the lock latches 32A–B.

The next operation involves the positioning of one or more intermediate sections 58A–D. Referring to FIG. 8, each intermediate section 58A–D preferably comprises four legs 43A–D interconnected by a plurality of braces 38A–D, 44 (38B not shown). The number and character of the braces 38A–D, 44 is a matter of choice for the designer. The intermediate sections 58A–D should all have the same general horizontal cross section as the vertical sections 42 of the top section 40.

After the top section 40 has been seated on the lock latches 32A–B, the brackets 39A–D are swung open and the travelling block 46 and elevators 28A–B are then lowered until the elevators 28A–B rest on the platform 15. The cables 53A–B are then disconnected from the travelling block 46 and the travelling block 46 is lowered further and coupled to the first of one or more intermediate sections 58A–D, preferably by cable 59. The travelling block 46 is then raised such that the first intermediate section 58A is hoisted into vertical position within the elevator guide section 20 and on top of elevators 28A–B. The brackets 39A–D are swung closed. The travelling block 46 is then disconnected from the first intermediate section 58A and reconnected to cables 53A–B. The travelling block 46 is raised, lifting the elevators 28A–B and first intermediate section 58A, until the top 61 of the first intermediate section 58A engages the bottom 62 of the top section 40.

The top section 40 and the first intermediate section 58A are then coupled together. The top section 40 may be coupled to the first intermediate section 58A using a variety of known techniques, such as bolting, pinning, riveting, or even welding. In a preferred embodiment, the top section 40, first intermediate section 58A, and subsequent intermediate sections 58B–D, may be coupled together by a flange connection shown in FIG. 4. FIG. 4 is illustrative of the preferred coupling between one leg 43B of the top section 40 and one leg 43B of the first intermediate section 58A. Legs 43B each have a plurality of holes 63 to accommodate both a nut and bolt 64, 65, or alternatively, rivets. Ball 67 and socket 68 form a ball socket joint that facilitates quick positioning of legs 43B, and thus quick connection by bolting or other means.

Figure 10:
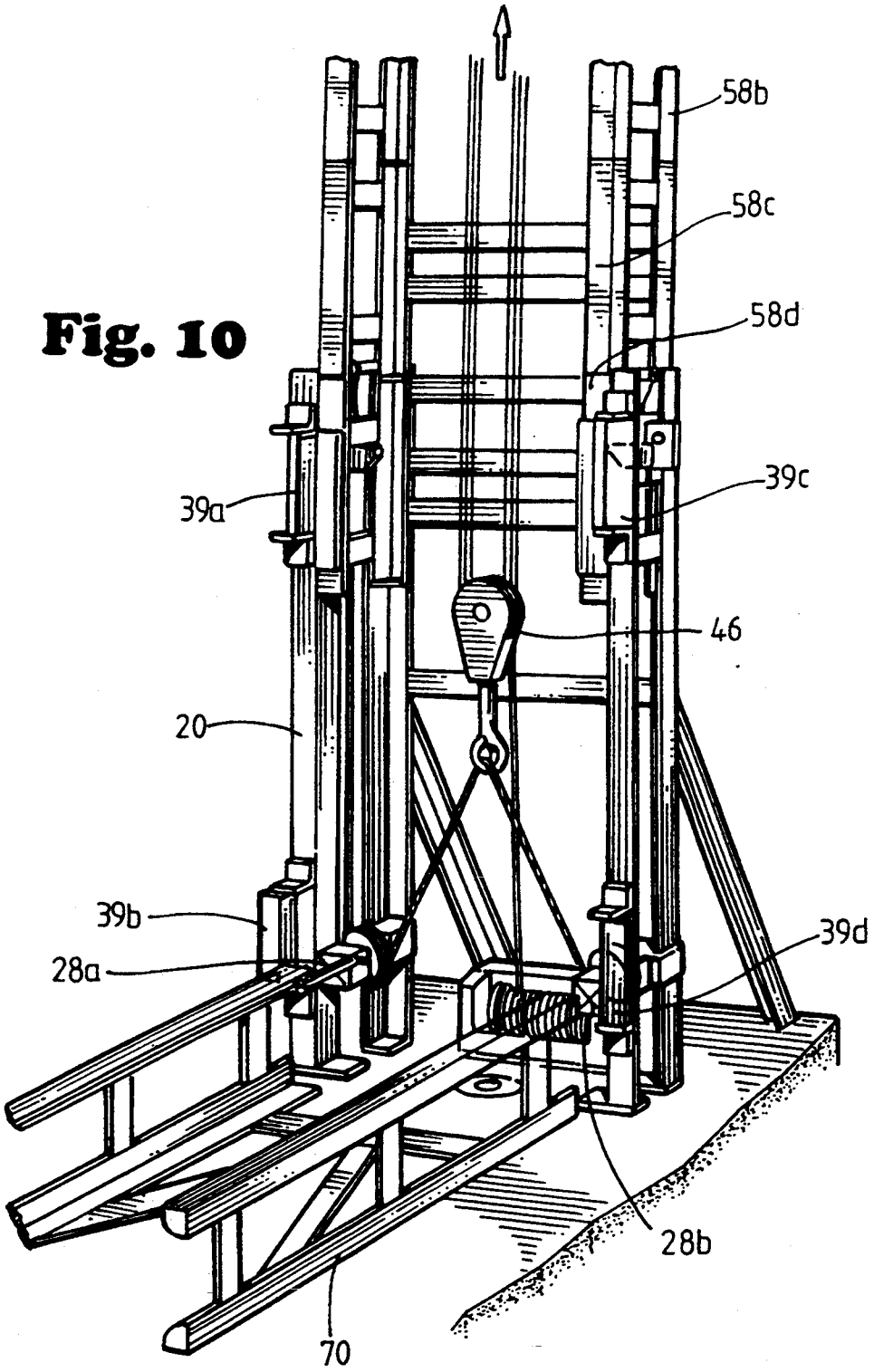
FIG. 10 depicts an elevator guide section with top and intermediate mast sections positioned therein and a mast bottom section in a pre-installation position, illustrated in a partial front pictorial view.

After the top section 40 and the first intermediate section 58A are coupled together, the top section 40 and the first intermediate section 58A are raised vertically by means of the travelling block 46 and elevators 28A–B until the first intermediate section 58A passes and seats on the lock latches 32A–B in the same manner as discussed previously with regard to the top section 40, with one important difference. As shown in FIG. 10, when the last intermediate section 58D is coupled to the previous intermediate section 58C, the top and intermediate sections 40, 58A–D are raised vertically until the next to lower-most braces 38A, 38C seat on lock latches 32A–B.

The last operation involves the placement of a bottom section 70. The bottom section 70 has the same general structure as the intermediate sections 58A–D. Referring to FIGS. 10–11, after the last intermediate section 58D is seated on the lock latches 32A–B, the brackets 39A–D are swung open and the travelling block 46 and elevators 28A–B are lowered to the drill platform 15. The top 72 of the bottom section 70 is coupled to the elevators 28A–B by the pin-slider mechanism 74 shown in FIG. 11, or another suitable coupling mechanism. As the elevators 28A–B are raised by travelling block 46, the bottom section 70 is hoisted into the elevator guide section 20 and underneath the elevators 28A–B, in a position coaxial with the top and intermediate sections 40, 58A–D. The brackets 39A–D are then swung closed. The elevators 28A–B are then disconnected from the bottom section 70 and raised to contact the last intermediate section 58D and lift the top and intermediate sections 40, 58A–D a sufficient distance to enable the lock latches 32A–B to be pivoted to a full upward position. The elevators 28A–B, and thus the top and intermediate sections 40, 58A–D, are then lowered until they rest on the top 72 of the bottom section 70. The elevators 28A–B are then coupled to both the last intermediate section 58D and the bottom section 70 as shown in FIG. 12.

The mast is now ready for drilling operations. To dismantle the mast 10, the foregoing operations are simply reversed.

The mast 10 and elevator guide section may be fabricated from ASTM A-36 steel or other suitable material, though ASTM A-572 steel or its equivalent is preferred for cold weather operations.

Many modifications and variations may be made in the techniques and structures described and illustrated herein without departing from the spirit and scope of the present invention. For example, while the figures show a generally rectangular cross section for the mast 10 and elevator guide section 20, it is understood that they may be formed in a variety of cross sections. Accordingly, the techniques and structures described and illustrated herein should be understood to be illustrative only and not limiting upon the scope of the present invention.

What is claimed is:

1. A method of assembling a mast having a plurality of sections on a drilling platform which has a drawworks and a crane, comprising the steps of:

A. erecting a guide section on said drill platform, said guide section being vertically disposed with respect to said drill platform, said guide section having an elevating mechanism operable to translate said mast sections vertically with respect to said guide section, said guide section having a plurality of lock latches to temporarily hold said mast sections when said elevating mechanism is translating downward with respect to said guide section;

B. by means of said crane, placing a mast top section on said elevating mechanism, said mast top section being vertically disposed within said guide section, said mast top section having a crown block prestrung with a first cable and coupled to said mast top section, said crown block having a travelling block suspended therefrom by, and prestrung with, said first cable, said travelling block being operatively coupled to said drawworks by said first cable, and operatively coupled to said elevating mechanism by a second cable and a third cable;

C. by means of said drawworks and travelling block, raising said elevating mechanism such that the bottom of said mast top section is held in position by said lock latches;

D. by means of said drawworks and travelling block, lowering said elevating mechanism to said drill platform;

E. by means of said drawworks and travelling block, placing a mast intermediate section on said elevating mechanism, said mast intermediate section being vertically disposed within said guide section;

F. by means of said drawworks and travelling block, raising said elevating mechanism until said mast intermediate section contacts said mast top section, thereafter said sections being coupled;

G. by means of said drawworks and travelling block, raising said elevating mechanism such that the bottom of said mast intermediate section is held in position by said lock latches;

H. repeating steps d, e, and g, wherein the top of each subsequent mast intermediate section is coupled to the bottom of the previous mast intermediate section, until all mast intermediate sections have been positioned;

I. coupling a mast bottom section to said elevating mechanism;

J. by means of said drawworks and travelling block, placing said mast bottom section within said guide section in a vertical disposition;

K. disconnecting said mast bottom section from said elevating mechanism;

L. by means of said drawworks and travelling block, raising said elevating mechanism to disengage the last installed mast intermediate section from said lock latches;

M. by means of said drawworks and travelling block, lowering said elevating mechanism such that said mast bottom section engages the lower sides of said elevating mechanism and said last installed mast intermediate section engages the upper sides of said elevating mechanism; and N. coupling said mast intermediate and bottom sections to said elevating mechanism.

2. The method of claim 1 comprising the further steps of:

(i) between steps (a) and (b), (d) and (e), and (h) and (i), opening a plurality of guide brackets mounted on said guide section to enable each said mast section to be placed within said guide section; and (ii) between steps (b) and (c), (e) and (f), and (j) and (k), closing said plurality of guide brackets to prevent said mast sections from moving without said guide section.

* * * * *